US009395141B2

(12) United States Patent
Cummings

(10) Patent No.: US 9,395,141 B2
(45) Date of Patent: Jul. 19, 2016

(54) TOY BOW PROJECTILE LAUNCHER WITH REPLACEABLE ELASTIC LAUNCHING ELEMENTS

(71) Applicant: Peter Cummings, Kowloon (HK)

(72) Inventor: Peter Cummings, Kowloon (HK)

(73) Assignee: KMA Concepts Limited, TST, Kowloon (HK)

( * ) Notice: Subject to any disclaimer, the term of this patent is extended or adjusted under 35 U.S.C. 154(b) by 0 days.

(21) Appl. No.: 14/556,427

(22) Filed: Dec. 1, 2014

(65) Prior Publication Data

US 2016/0153738 A1 Jun. 2, 2016

(51) Int. Cl.

| | |
|---|---|
| ***F41B 3/02*** | (2006.01) |
| ***F41B 5/00*** | (2006.01) |
| ***F41B 5/14*** | (2006.01) |
| ***F41B 7/08*** | (2006.01) |
| *A63H 33/18* | (2006.01) |

(52) U.S. Cl.

CPC ..... *F41B 5/0094* (2013.01); *F41B 3/02* (2013.01); *F41B 5/1411* (2013.01); *F41B 7/08* (2013.01); *A63H 33/18* (2013.01)

(58) Field of Classification Search

CPC ..... F41B 3/02; F41B 7/08; F41B 5/0094; A63H 33/18

USPC ..... 124/17, 20.1, 20.3, 23.1; 473/578

See application file for complete search history.

(56) References Cited

U.S. PATENT DOCUMENTS 3,085,560 A * 4/1963 Peters ..... F41B 5/0094 124/23.1
3,126,880 A * 3/1964 Loe ..... F41B 3/02 124/22
4,458,658 A * 7/1984 Blair ..... F41B 3/02 124/20.1
4,703,744 A * 11/1987 Taylor ..... F41B 3/02 124/20.1
5,247,920 A * 9/1993 Harbin ..... A63F 9/0252 124/17
5,279,276 A * 1/1994 Nagel ..... F41B 3/02 124/20.1
5,282,453 A * 2/1994 Chia ..... F42B 6/00 124/20.1
5,579,749 A * 12/1996 Wilkinson ..... F41B 3/005 124/16
5,678,528 A * 10/1997 Hadley ..... F41B 5/12 124/24.1
5,830,029 A * 11/1998 Siegel ..... A63H 33/28 446/15
6,247,990 B1 * 6/2001 Moorhouse ..... A63H 27/007 446/45
6,500,042 B1 * 12/2002 LaPointe ..... A63H 33/18 124/20.3
7,640,922 B2 * 1/2010 Siebelink ..... F41B 3/005 124/17
7,748,369 B2 * 7/2010 Chee ..... F41B 3/02 124/20.1
8,091,539 B2 * 1/2012 Siebelink ..... F41B 3/005 124/17
8,485,168 B2 * 7/2013 Walterscheid ..... F41B 3/02 124/20.1

(Continued)

*Primary Examiner* — Alexander Niconovich
(74) *Attorney, Agent, or Firm* — LaMorte & Associates, P.C.

(57) ABSTRACT

A toy projectile launcher that launches projectiles with elastic elements. Each elastic element is designed to be easily replaced on the projectile launcher. Each replaceable elastic element has two ends. An anchor block is provided that receives and retains at least one of the two ends. The anchor block is received within an anchor receptacle. A locking mechanism is used that selectively locks the anchor block within the anchor receptacle. The elastic elements extend from the anchor receptacles and present projectile engagement structures that can be hooked by the toy projectile being launched.

12 Claims, 6 Drawing Sheets

(56) References Cited

U.S. PATENT DOCUMENTS

| | | | | |
|---|---|---|---|---|
| 8,662,060 | B2 * | 3/2014 | Walterscheid | F41B 5/12 124/20.3 |
| 8,689,773 | B2 * | 4/2014 | Walterscheid | F41B 5/0094 124/23.1 |
| 9,022,012 | B2 * | 5/2015 | Loetz | A63F 9/0278 124/18 |
| 9,097,483 | B2 * | 8/2015 | Walterscheid | F41B 3/02 |
| 9,151,566 | B2 * | 10/2015 | Cummings | F41B 5/0094 |
| 9,239,205 | B2 * | 1/2016 | Cummings | F41B 7/08 |
| 9,310,171 | B2 * | 4/2016 | Cummings | F42B 6/02 |
| 2012/0060807 | A1 * | 3/2012 | Walterscheid | F41B 5/12 124/20.3 |
| 2012/0160224 | A1 * | 6/2012 | Walterscheid | F41B 5/0094 124/20.1 |
| 2013/0167819 | A1 * | 7/2013 | Walterscheid | F41B 3/02 124/20.1 |
| 2014/0000577 | A1 * | 1/2014 | Cummings | A63F 9/0252 124/20.1 |
| 2014/0338647 | A1 * | 11/2014 | Cummings | F41B 7/08 124/20.3 |
| 2015/0119174 | A1 * | 4/2015 | Cummings | F42B 6/02 473/585 |
| 2015/0176940 | A1 * | 6/2015 | Cummings | F41B 7/08 124/20.3 |

* cited by examiner

TOY BOW PROJECTILE LAUNCHER WITH REPLACEABLE ELASTIC LAUNCHING ELEMENTS

BACKGROUND OF THE INVENTION

1. Field of the Invention

In general, the present invention relates to toy bow systems, where a toy bow is used to launch a toy projectile into flight.

2. Prior Art Description

Bow and arrow sets that are designed for children's play have existed throughout recorded history. In the modern era, toy bow and arrow sets typically have a plastic molded bow, a string, and safety-tipped arrows. To ensure safety, the functional design of a toy bow is also commonly altered. In a real bow, the string has a fixed length. The spring force used to launch an arrow comes from the flexing of the arms of the bow. The problem with this design is its failure mode. If a bow is drawn beyond its limit, then the arms or the string of the bow may break. Depending upon where the breakage occurs, the broken string and/or bow may fly toward the person holding the bow as the stored energy is accidentally released.

To reduce the likelihood of this hazard from occurring, many toy bows are manufactured as static structures. An elastic string is used to create the arrow launching force. If such a bow is overdrawn, there is no significant chance of the bow breaking. Rather, the elastic string will break and will most likely move in a direction away from the person drawing the bow. The failure mode of a string breaking is far less dangerous than the failure mode of the bow breaking. However, the failure mode of a broken string does present some danger depending upon where the elastic string breaks and how much energy is stored in the elastic string at the time it breaks.

Toy bows that use a static bow and an elastic string are exemplified by U.S. Pat. No. 5,247,920 to Harbin, entitled Toy Bow; and U.S. Pat. No. 7,748,369 to Chee, entitled Launching Apparatus and Assembly. The Applicant has other designs for static bows that use elastic strings. These other designs are disclosed in U.S. Pat. No. 8,689,773, U.S. Pat. No. 8,662,060, and U.S. Pat. No. 8,485,168.

Many toy bows that have elastic strings use elastic strings that are made from a synthetic polymer, such as silicon, TPR or some other synthetic rubber. On the toy, such elastic strings are constantly under tension. As such, if the material of the string creeps or degrades, the elastic string will break. This stops the toy bow from being functional.

Most all plastic degrades in some fashion over time. However, it has been found that one of the fastest ways to degrade the preferred polymers used for the bowstring is to expose the bowstring to light, especially ultraviolet light. A bowstring that can last for months inside a home may only last for a few days if taken outside and left in sunlight. Damage to the elastic bowstring caused by exposure to light has therefore caused products to be returned and/or consumers' dissatisfaction with the toy manufacturer.

A need therefore exists for a toy bow design that enables the elastic strings of a toy bow to be readily replaced by a retail customer. In this manner, the elastic strings can be periodically replaced, therein greatly increasing the play life of the toy and consumer satisfaction with the toy. This need is met by the present invention as described and claimed below.

SUMMARY OF THE INVENTION

The present invention is a toy projectile launcher that launches projectiles with elastic elements. Each elastic element has a length that extends between a first end and a second end. Each elastic element supports a projectile engagement structure that engages the projectile as the elastic element is stretched.

Each elastic element is designed to be easily replaced on the projectile launcher. The projectile launcher has an anchor receptacle for each of the elastic elements. Each of the elastic elements has an enlarged stop proximate its first end. An anchor block is provided for each anchor receptacle. The anchor blocks are received within the anchor receptacles. The anchor blocks have holes extending therethrough. The holes are sized to enable a length of each elastic element to pass therethrough. However, the holes are too small to enable the enlarged stops to pass.

Each elastic element extends through a hole in an anchor block with its enlarged head becoming wedged within the hole in the anchor block. The anchor block is then set in the anchor receptacle and locked in place using a locking mechanism. The elastic element extends through the hole and out of the anchor receptacle and supports the projectile engagement structure at a point where it can be engaged by a projectile.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention toy bow projectile launcher can be embodied in many ways, only a few of the embodiments of the present invention system are illustrated. These embodiments are selected in order to set forth the best modes contemplated for the invention. The illustrated embodiments, however, are merely exemplary and should not be considered limitations when interpreting the scope of the appended claims.

Figure 1:
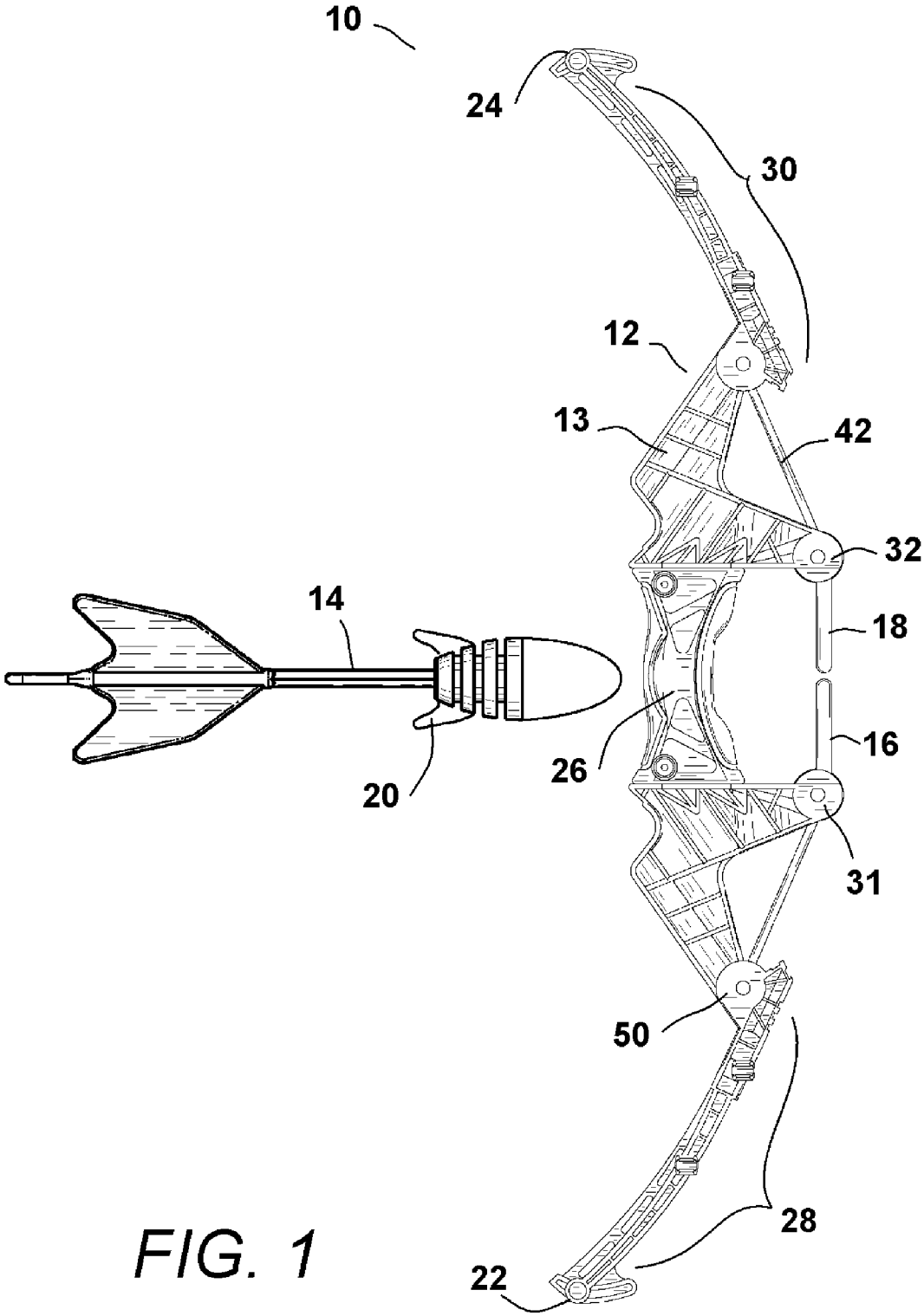
FIG. 1 is a partially exploded perspective view of an exemplary embodiment of a toy bow and toy projectile in combination.
Figure 2:
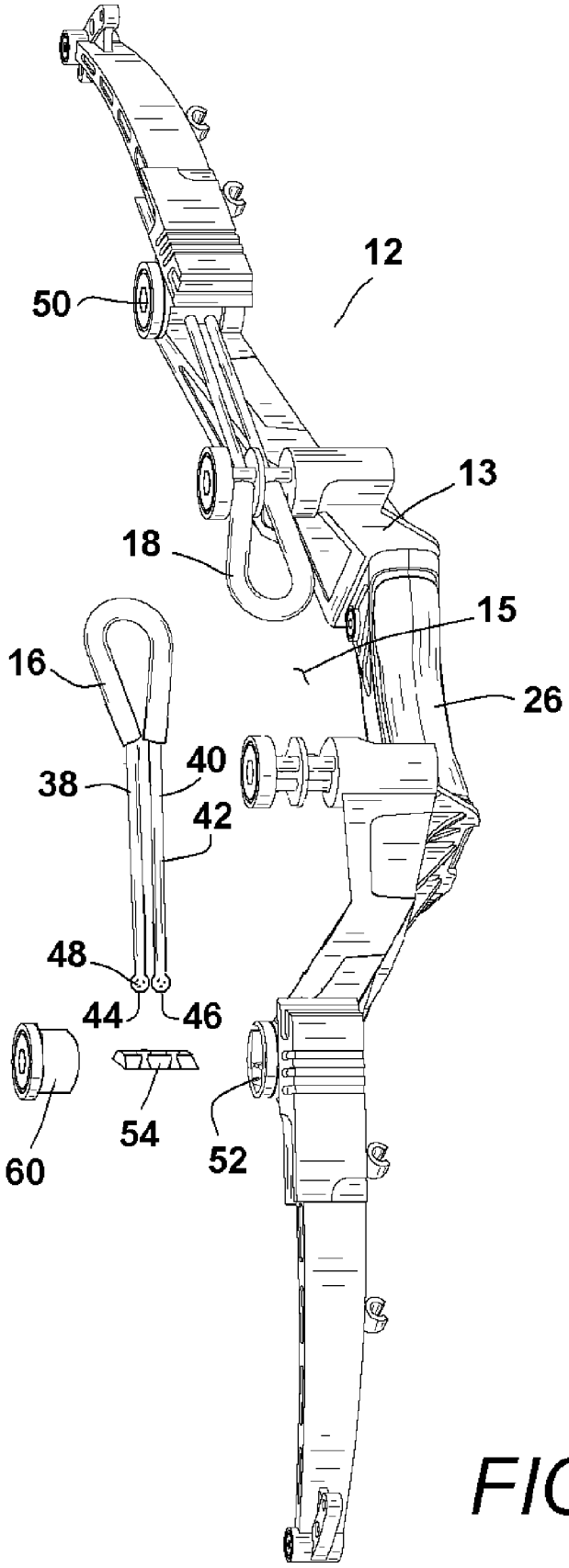
FIG. 2 is a side view of the toy bow and toy projectile shown in FIG. 1.

Referring to both FIG. 1 and FIG. 2 a bow and arrow system 10 is shown. The bow and arrow system 10 is similar in structure to that found in the Applicant's earlier patent; namely U.S. Pat. No. 8,662,060, the disclosure of which is herein incorporated by reference. The primary difference between the present invention bow and arrow system 10 and the earlier patent, is the new technology of replaceable elastic loops, which are used as the bow strings.

The bow and arrow system 10 includes a bow projectile launcher 12 and at least one arrow projectile 14. The bow projectile launcher 12 has a bow frame 13 that is rigid. The forces used to propel the arrow projectile 14 from the bow frame 13 are provided by two separate and distinct elastic loop elements 16, 18. The elastic loop elements 16, 18 serve as the projectile engagement structures for the projectile launcher 12. The arrow projectile 14 has hook projections 20 that engage both of the elastic loops 16, 18. As a person engages an arrow projectile 14 with the elastic loops 16, 18 and pulls on the arrow projectile 14, both elastic loops 16, 18 stretch. Since there are two elastic loops 16, 18, each of the elastic loops 16, 18 needs only provide half the force needed to propel the arrow projectile 14 into flight. The elastic loops 16, 18 are therefore difficult to overstretch in the proper operation of the toy. Furthermore, should either of the elastic loops 16, 18 suddenly break, the orientation of the broken elastic loops prevents it from whipping toward the user. Lastly, since the arrow projectile 14 engages two separate and distinct elastic loops 16, 18, the chances of both elastic loops breaking simultaneously are highly improbable. Accordingly, if one elastic loop breaks, the arrow projectile 14 will still be engaged with the second elastic loop and the person pulling the arrow projectile 14 back will not likely pull the arrow projectile 14 into himself upon the breakage of the one elastic loop.

The bow frame 13 has a first end 22, a second end 24, and a handle 26 in its central region. A first arm section 28 extends from the handle 26 to the first end 22. Likewise, a second arm section 30 extends from the handle 26 to the second end 24. The first arm section 28 and the second arm section 30 are disposed in a common plane. The handle 26 is offset from the common plane so as not to interfere with the path of the arrow projectile 14. This creates an open central region 15 between the first and second arm sections 28, 30.

The projectile launcher 12 has two pivot post structures 31, 32 that are located at the bottom of the second arm section 30 and the top of the first arm section 28. Each pivot post structure 31, 32 guides the elastic loops 16, 18 as they are stretched.

The elastic loops 16, 18 are each made of a flexible length 42 of elastomeric material having a first end 44 and an opposite second end 46. Each length 42 of elastomeric material is bent to form the elastic loops 16, 18. Each of the elastic loops 16, 18 therefore is configured as a loop having two runs 38, 40. The runs 38, 40 of the two elastic loops 16, 18 extend through the pivot post structures 31, 32. Enlarged stops 48 are attached to the first and second ends 44, 46 of the elastic loops 16, 18. The stops 48 can simply be knots tied into the length 42 of elastomeric material. However, the enlarged stops 48 are preferably created by inserting small obstructions into the first and second ends 44, 46 of the length 42 of the elastomeric material.

Figure 3:
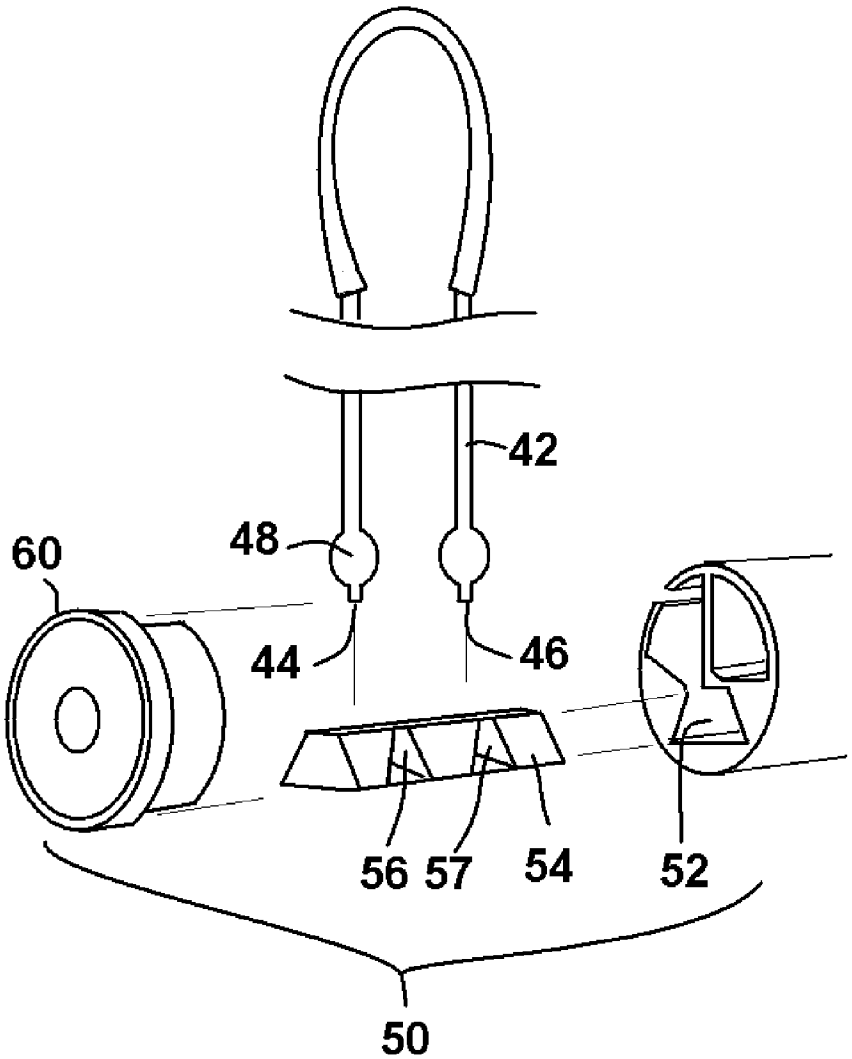
FIG. 3 is an enlarged perspective view of an anchor assembly on the exemplary toy bow.
Figure 4:
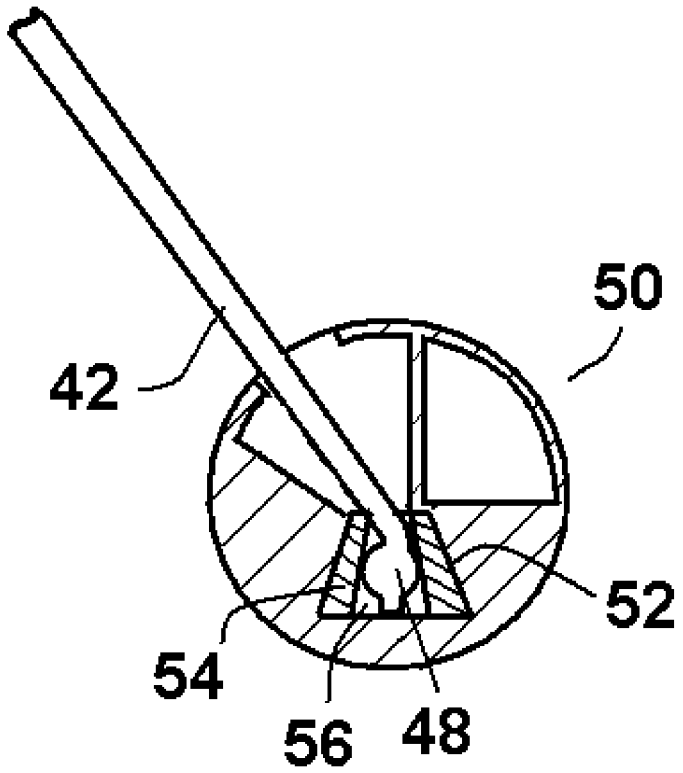
FIG. 4 is a cross-sectional view of the anchor assembly on the exemplary toy bow.

Referring to FIG. 3 and FIG. 4 in conjunction with FIG. 1 and FIG. 2, it can be seen that the ends 44, 46 of each of the elastic loops 16, 18 are anchored to the projectile launcher 12. The ends 44, 46 attach to the projectile launcher 12 at anchor assemblies 50. Although only one anchor assembly 50 is shown in FIG. 3 and FIG. 4, it will be understood that the description to follow applies equally to both anchor assemblies 50.

Each of the anchor assemblies 50 defines an anchor receptacle 52. The anchor receptacle 52 is a shaped opening that is sized to selectively receive and retain an anchor block 54. An anchor block 54 is provided for each of the elastic loops 16, 18. The anchor block 54 contains two holes 56, 57 through which the length 42 of elastic material can pass. However, the holes 56, 57 are tapered and become too small for the enlarged stops 48 to pass. As such, the first end 44 and second end 46 of each elastic loop 16, 18 become mechanically locked within the anchor block 54 as the elastic loops 16, 18 are stretched.

The anchor assemblies 50 are located on the first and second arm sections 28, 30. When an anchor receptacle 52 receives and anchor block 54, the ends 44, 46 of an elastic loop 16, 18 become anchored in place on the bow frame 13. A locking mechanism 60, in the form of a cap, locking finger or similar obstruction is provided to inhibit the accidental removal of the anchor block 54 from the anchor receptacle 52.

From the above description, it will be understood that if one or both of the elastic loops 16, 18 ever becomes worn or breaks, it can quickly be replaced. A user need only to remove the cap 60, slide the anchor block 54 out of the anchor receptacle 52, and remove the broken element(s). A new elastic loop can then be inserted into the anchor block 54 and the anchor block 54 be reset into the anchor receptacle 52.

Figure 5:
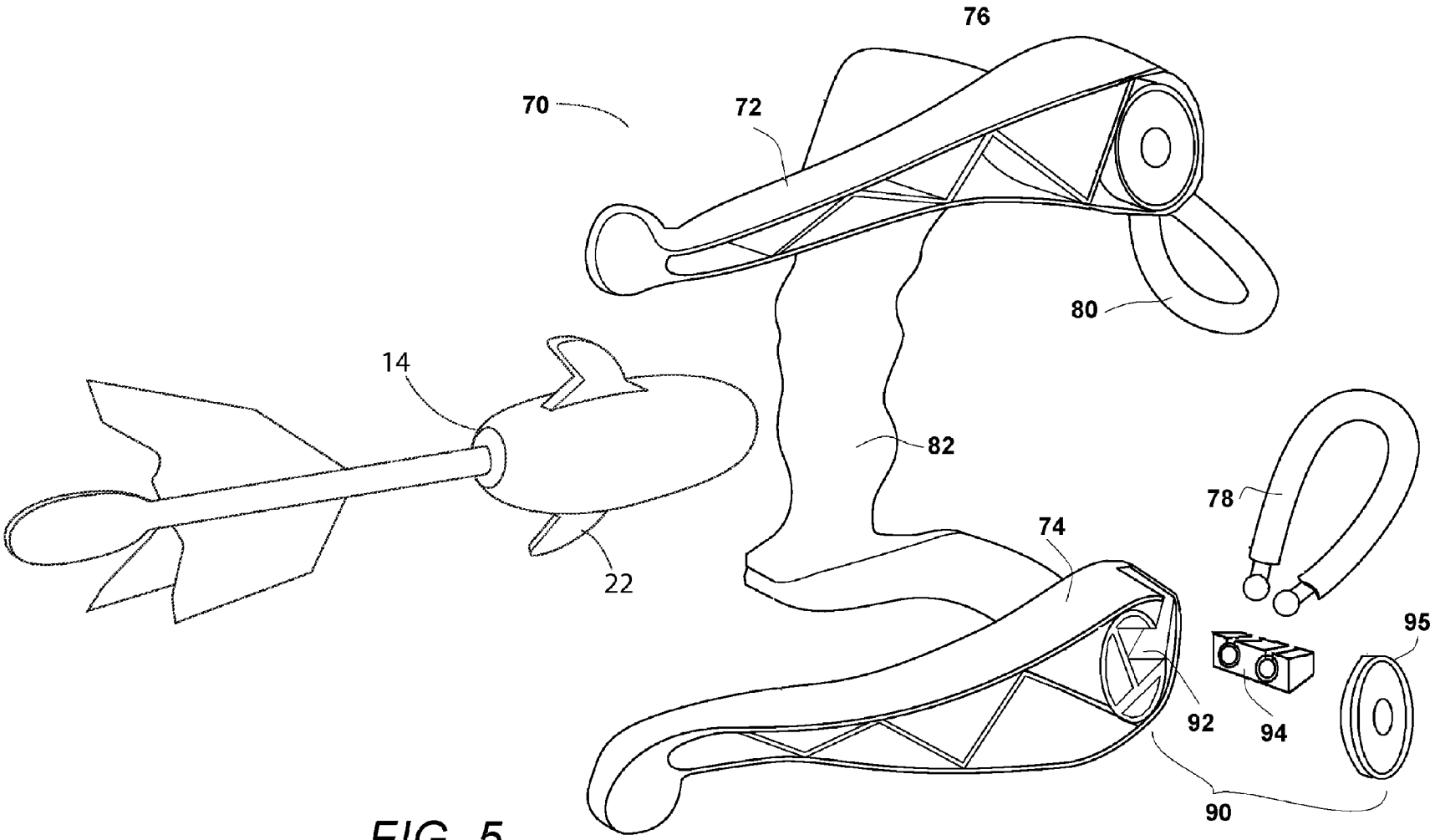
FIG. 5 is a partially exploded perspective view of an alternate embodiment of a toy bow projectile launcher.

Referring to FIG. 5, an alternate embodiment of a bow and arrow system 70 is shown. The bow and arrow system 70 are similar in structure to the bow and arrow system disclosed by the Applicant in U.S. Pat. No. 8,689,773, the disclosure of which is incorporated by reference. Again, the primary difference in the present invention is the technology of replaceable elastic elements.

Referring to FIG. 5, it can be seen that a launcher 72 is provided that includes two spring-loaded arm elements 74, 76. The force used to propel the toy projectile 14 is provided by the spring energy stored by the spring-loaded arm elements 74, 76 and the stretching of two elastic loops 78, 80 that extend from the arm elements 74, 76. The two elastic loops 78, 80 serve as the projectile engagement structures. The toy projectile 14 has hook projections 20 that engage both of the elastic loops 78, 80. As a person engages the toy projectile 14 with the elastic loops 78, 80 and pulls on the toy projectile 14, both elastic loops 78, 80 stretch.

The elastic loops 78, 80 attach to the ends of the arm elements 74, 76 and dangle into the open area between the arm elements 74, 76 adjacent the handle 82. The elastic loops 78, 80 attach to the projectile launcher 12 at anchor assemblies 90.

Each of the anchor assemblies 90 defines an anchor receptacle 92. The anchor receptacle 92 is a shaped opening that is sized to selectively receive and retain an anchor block 94. An anchor block 94 is provided for each of the elastic loops 78, 80. The anchor block 94 engages the elastic loops 78, 80 in the same manner as was previously described with reference to FIGS. 3 and 4. As such, the ends of each elastic loop 78, 80 become mechanically locked within an anchor block 94 as the elastic loops 78, 80 are stretched.

From the above description, it will be understood that if one or both of the elastic loops 78, 80 ever becomes worn or breaks, it can quickly be replaced. A user need only slide the anchor block 94 out of the anchor receptacle 92 and remove the broken elements. A new elastic loop can then be thread into the anchor block 94 and the anchor block 94 be reinserted into the anchor receptacle 92. The anchor block 94 is held in place by a locking mechanism 95, in the form of a cap, locking finger or similar feature.

Figure 6:
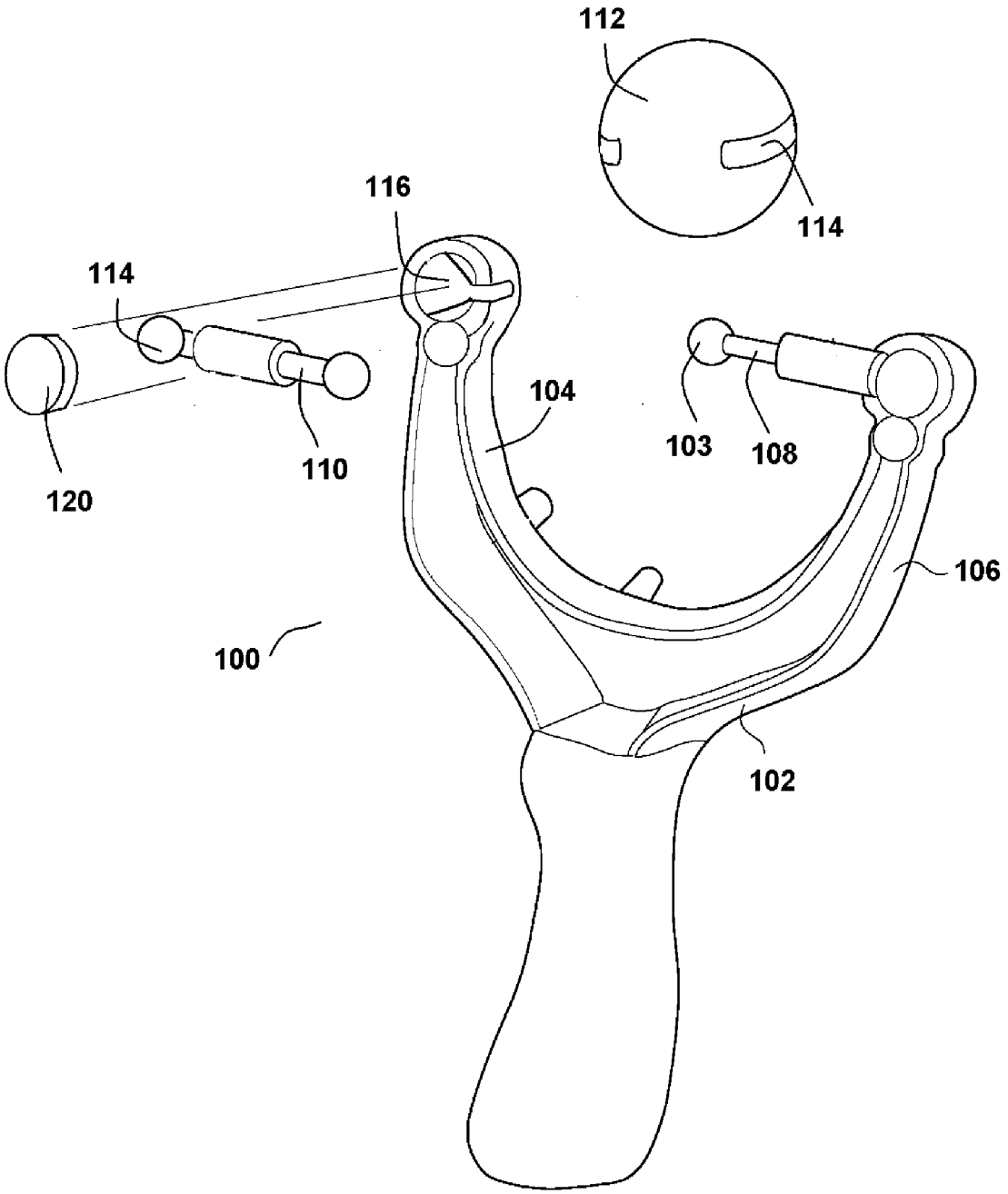
FIG. 6 is a partially exploded perspective view of an alternate embodiment of a toy projectile launcher configured as a sling shot.

Referring to FIG. 6, an alternate embodiment of a projectile system 100 is shown. The projectile system 100 is in similar in structure to the projectile system disclosed by the Applicant in U.S. Pat. No. 8,485,168, the disclosure of which is incorporated by reference. Again, the primary difference in the present invention is the technology of replaceable elastic elements.

Referring to FIG. 6, it can be seen that a slingshot launcher 102 is provided that includes two arm elements 104, 106. The force used to propel the toy projectile is provided by the spring energy stored by stretching of two elastic elements 108, 110 that extend from the arm elements 104, 106. A toy projectile 112 is provided that has slots 114 that engage nubs 103 at the ends of the elastic elements 108, 110. The nubs 103 serve as the projectile engagement structures. As a person engages the toy projectile 112 with the elastic elements 108, 110 and pulls on the toy projectile 112, both elastic elements 108, 110 stretch.

The elastic elements 108, 110 have enlarged ends 114 that sit in anchor receptacles 116 at the top of each of the arm elements 104, 106. Each of the anchor receptacles 116 is a shaped opening that is sized to selectively receive and retain an enlarged end 114 of an elastic element 108, 110. Once engaged with an anchor receptacle 116, the enlarged end 114 of each of the arm elements 104, 106 is locked in place with an end cap 120. The end cap 120 serves as a locking mechanism and prevents the elastic elements 108, 110 from disengaging the anchor receptacles 116. As such, the enlarged end 114 of each elastic element 108, 110 becomes mechanically locked within the anchor receptacles 116 as the elastic elements 108, 110 are stretched.

From the above description, it will be understood that if one or both of the elastic elements 108, 110 were to become worn or breaks, it can quickly be replaced. A user need only remove the end cap 120 and slide the end of the elastic element 108, 110 out of the anchor receptacle 116. A new elastic element can then be set into place within the anchor receptacle 116.

It will be understood that the embodiments of the present invention that are illustrated and described are merely exemplary and that a person skilled in the art can make many variations to those embodiments. For instance, the toy projectile launcher can be configured as many types of bows, crossbows and slingshots. Likewise, the arrow projectiles can be configured as airplanes, rocket ships or any other flying projectile. All such embodiments are intended to be included within the scope of the present invention as defined by the claims.

What is claimed is:

1. A toy projectile launcher, comprising:

an elastic element having a length that extends between a first end and a second end, wherein said elastic element supports a projectile engagement structure;

a first enlarged stop disposed along said elastic element proximate said first end;

a second enlarged stop disposed along said elastic element proximate said second end;

a launcher body having a anchor receptacle formed into said launcher body;

an anchor block that is sized to pass into said anchor receptacle, wherein said anchor block has a first hole and a second hole extending therethrough, said first hole and said second hole being sized to enable said length of said elastic element to pass therethrough, and wherein said first hole is sized to cause said first enlarged stop to wedge therein, and said second hole is sized to cause said second enlarged stop to wedge therein;

wherein said elastic element extends through said first hole and said second hole, with said first enlarged stop wedging within said first hole in said anchor block and said second enlarged stop wedging within said second hole;

wherein said anchor block is received within said anchor receptacle;

wherein said elastic element extends through both said first hole and said second hole to support said projectile engagement structure; and a locking mechanism for retaining said anchor block within said anchor receptacle.

2. The launcher according to claim 1, wherein said projectile engagement structure is a loop structure for engaging a hook on a projectile.

3. The launcher according to claim 1, wherein said projectile engagement structure is disposed between said first end and said second end.

4. A toy projectile launcher, comprising:

an elastic element having a length that extends between a first end and a second end, wherein said elastic element supports a projectile engagement structure;

an anchor block that receives and retains said first end and said second end of said elastic element;

a launcher body having an anchor receptacle, said anchor receptacle being accessible through an open end, wherein said anchor block passes into said anchor receptacle through said open end;

a selectively removable locking mechanism that obstructs said open end and locks said anchor block within said anchor receptacle;

wherein said elastic element extends out of said anchor receptacle and supports said projectile engagement structure.

5. The launcher according to claim 4, wherein said anchor block has a first hole and a second hole extending therethrough, said first hole and a second hole being sized to enable said length of said elastic element to pass therethrough, wherein said first hole is sized to cause said first end to wedge therein, and said second hole is to cause said second end to wedge therein;

wherein said elastic element extends through said first hole and said second hole, with said first end wedging within said first hole and said second end wedging in said second hole.

6. The launcher according to claim 4, wherein said projectile engagement structure is a loop structure for engaging a hook on a projectile.

7. The launcher according to claim 4, wherein said projectile engagement structure is disposed between said first end and said second end.

8. A toy projectile launcher, comprising:

a launcher body that defines an anchor receptacle;

a replaceable elastic element having two ends;

an anchor block that receives and retains said two ends of said replaceable elastic element;

wherein said anchor block is received within said anchor receptacle; and a locking mechanism that selectively obstructs said anchor receptacle and locks said anchor block within said anchor receptacle.

9. The launcher according to claim 8, wherein enlarged stops are disposed on said elastic element proximate said two ends.

10. The launcher according to claim 9, wherein said anchor block engages said enlarged stops.

11. The launcher according to claim 8, wherein said anchor receptacle has an open end through which said anchor blocks enters and leaves said anchor receptacle.

12. The launcher according to claim 11, wherein said locking mechanism is a removable cap that obstructs said open end.

* * * * *